US005211861A

United States Patent [19]

Lafratta et al.

[11] Patent Number: 5,211,861

[45] Date of Patent: May 18, 1993

[54] LIQUID AQUEOUS COMPOSITIONS COMPRISING PERFLUOROPOLYETHEREAL COMPOUNDS SUITABLE AS LUBRICANTS IN THE PLASTIC PROCESSING OF METALS

[75] Inventors: Pietro Lafratta; Alba Chittofrati, both of Milan, Italy

[73] Assignee: Ausimont S.r.l., Milan, Italy

[21] Appl. No.: 643,269

[22] Filed: Jan. 22, 1991

Related U.S. Application Data

[63] Continuation-in-part of Ser. No. 409,051, Sep. 19, 1989, abandoned.

[30] Foreign Application Priority Data

Sep. 19, 1988 [IT] Italy ..... 21998 A/88

[51] Int. Cl.[5] ..... C10M 173/00; C10M 131/10; C10M 131/12; C10M 147/00

[52] U.S. Cl. ..... 252/33.6; 252/49.3; 252/49.5; 252/54; 252/54.6; 72/42

[58] Field of Search ..... 252/49.3, 49.5, 33.6, 252/54, 54.6; 72/42

[56] References Cited

U.S. PATENT DOCUMENTS

| | | | |
|---|---|---|---|
| 3,250,808 | 5/1966 | Moore et al. | 260/535 |
| 3,665,041 | 5/1972 | Sianesi et al. | 260/615 A |
| 4,213,870 | 7/1980 | Loran | 252/51.5 R |
| 4,472,290 | 9/1984 | Caporiccio et al. | 252/51.5 R |
| 4,523,039 | 6/1985 | Lagow et al. | 568/615 |
| 4,585,565 | 4/1986 | Tsai | 252/49.5 |
| 4,618,441 | 10/1986 | Tsai | 252/49.5 |
| 4,657,687 | 4/1987 | Caporiccio et al. | 252/54 |
| 4,720,527 | 1/1988 | Caporiccio et al. | 525/403 |
| 4,755,330 | 7/1988 | Viola et al. | 260/544 F |
| 4,761,241 | 8/1988 | Kobori et al. | 252/32.5 |
| 4,803,005 | 2/1989 | Juhlke et al. | 252/58 |
| 4,836,944 | 6/1989 | Tohzuka et al. | 252/54 |
| 4,845,268 | 7/1989 | Ohsaka et al. | 560/184 |
| 4,990,283 | 2/1991 | Visca et al. | 252/49.5 |

FOREIGN PATENT DOCUMENTS

| | | |
|---|---|---|
| 987655 | 4/1976 | Canada . |
| 0048216 | 3/1982 | European Pat. Off. . |
| 0148482 | 12/1984 | European Pat. Off. . |
| 0250766 | 1/1988 | European Pat. Off. . |
| 0340739 | 5/1989 | European Pat. Off. . |
| 0340740 | 5/1989 | European Pat. Off. . |

OTHER PUBLICATIONS

J. Am. Chem. Soc., 1985, 107, 1197-1201, Persico et al., "Synthesis of Perfluoropolyethers via Hydrocarbon Polyesters: A New General Method".

*Primary Examiner*—Jerry Johnson
*Attorney, Agent, or Firm*—Stevens, Davis, Miller & Mosher

[57] ABSTRACT

Aqueous compositions containing from 1% to 40% by weight of a perfluoropolyethereal compound having a molecular weight ranging from 400 to 5,000 and containing carboxylic end groups, which are salified with an organic or inorganic base are disclosed. The compositions are useful as lubricating/refrigerating liquids in the plastic cold processing processes of metals, in particular, rolling, dishing, drawing, and the like.

6 Claims, No Drawings

LIQUID AQUEOUS COMPOSITIONS COMPRISING PERFLUOROPOLYETHEREAL COMPOUNDS SUITABLE AS LUBRICANTS IN THE PLASTIC PROCESSING OF METALS

CROSS REFERENCE TO RELATED APPLICATIONS

This application is a continuation-in-part of U.S. patent application Ser. No. 409,051 filed Sep.19, 1989, now abandoned, the entire disclosure of which is incorporated herein by reference.

FIELD OF THE INVENTION

The present invention relates to a liquid water-based composition useful as a lubricating and refrigerating liquid in the plastic processing of metals, which comprises, as a basic ingredient, a perfluoropolyethereal compound.

BACKGROUND OF THE INVENTION

The composition according to the invention is suitable in particular for rolling, dishing, drawing, pressing of metals in general of the iron and non-iron type such as steel, copper, aluminum, and alloys thereof.

The use of liquids acting as lubricants in the above metal processing processes is well known. The liquids, which generally consist of hydrocarbon oils with various additives for improving the performances thereof under severe operative conditions (high pressures, high temperatures), exhibit the drawback of being inflammable.

In latest times, the use of aqueous emulsions comprising matters endowed with lubricating properties has been suggested. Such products, besides being practically not affected by the drawback of being inflammable under the operating conditions, satisfactorily fulfill also the task of cooling the materials under processing. Lubricating compositions of this type are described, for example, in European Patent No. 48,216 (Alusuisse), Canadian Patent No. 987,655 (Exxon), U.S. Pat. No. 4,585,565 (Alcoa), and U.S. Pat. No. 4,618,441 (Alcoa), all hereby incorporated by reference. Although many compositions in the form of aqueous emulsions have been suggested, it should be understood that it is very difficult to prepare a composition which exhibits excellent performances regarding lubrication and cooling, a low friction coefficient (to achieve high reduction ratios). Furthermore, the composition should be endowed with good lubricating properties at high pressure. At the same time, the composition should be free from various drawbacks such as instability of the emulsion which can undergo a demixing under operating conditions.

The known compositions always require specific additives depending on the fields of use, to reach good values of the specific properties which are of major interest for the expected use.

DETAILED DESCRIPTION OF THE INVENTION

The compositions of the invention, besides exerting an excellent lubricating action, which permits obtaining, in the rolling process, a strong thickness reduction in a single run or pass, effect an efficacious cooling of the material being processed by virtue of the high water content of the composition. Such content is at least 60% by weight and preferably of at least 80% by weight.

Furthermore, they do not leave harmful product residues on the processed material. In a few cases, it is possible to avoid a subsequent washing. The compositions according to the invention possess a high chemical stability and, if they are in the form of microemulsion, an unlimited physical stability. Moreover, the residues remaining after water evaporation are unflammable.

An essential component of the lubricating-refrigerating compositions according to the invention is a perfluoropolyether having an average molecular weight of at least 400 and preferably not higher than 5,000, with end groups of the perfluoropolyethereal chain of neutral type (perfluoroalkyl groups) and/or of polar functional type. The perfluoropolyethereal compound is present in the aqueous composition either in the form of solution when the average molecular weight does not exceed 1,000 and the end groups are particularly hydrophilic (carboxylic groups), or in the form of microemulsions when the molecular weight exceeds 1,000 or also in the presence of low molecular weights when the end groups are neutral (perfluoroalkyl groups). The term "microemulsion" designates a liquid, macroscopically single-phase composition, which is limpid or slightly opalescent, optically isotropic, indefinitely stable in a defined temperature range comprising the temperature at which the composition is used.

The microemulsions of both neutral and functional perfluoropolyether are prepared according to the prior patent application EP-A-250766, hereby incorporated by reference.

Perfluoropolyethereal compounds which are particularly suitable as basic components of the aqueous composition of the present invention are the ones having a carboxylic end group suitably salified with organic or inorganic bases, in particular with ammonia or triethanolamine.

The amount of total perfluoropolyethereal compounds in the lubricating composition according to the invention ranges form about 1% to 40% by weight, preferably from 2% to 20%.

The perfluoropolyethers suited to form the lubricating compositions which are the object of the present invention are in particular the ones which have an average molecular weight from about 400 to 5,000 and preferably from 600 to 2,000, and belong in particular to one or more of the following classes:

1) (Fomblin ®Y-structure)

$$R_fO(\underset{\underset{CF_3}{|}}{CF}-CF_2O)_n(\underset{\underset{CF_3}{|}}{CFO})_m(CF_2O)_pR'_f$$

with a random distribution of the perfluorooxyalkylene units, wherein $R_f$ and $R'_f$, like or different from each other, are $-CF_3-$, $-C_2F_5$, $-C_3F_7$, or $-COOH$, $-CF_2COOH$, wherein $1<n<30$, $0<m<10$, $0<p<10$ and $m+n+p=1-30$ and have such values to meet the above average molecular weight requirements;

2) (Fomblin ®Z-structure) $R_fO(CF_2CF_2O)_n(CF_2O)_mR'_f$, with a random distribution of the perfluorooxyalkylene units, wherein $R_f$ and $R'_f$, like or different from each other, are $-CF_3$ or $-C_2F_5$, or $-COOH$, $-CF_2COOH$ wherein $2<n<40$, $1<m<80$ and $m/n=0.5-2$ and have such values as to meet the above requirements;

3) (Fomblin ®K-structure)

$$R_fO(CF_2CF_2O)_n(CF_2O)_m(\underset{\underset{CF_3}{|}}{CFO})_p(\underset{\underset{CF_3}{|}}{CF}-CF_2O)_q-R'_f$$

with a random distribution of the perfluorooxyalkylene units, wherein $R_f$ and $R'_f$, like or different from each other, are $-CF_3$, $-C_2F_5$ or $-C_3F_7$, or one of the above carboxylic radicals, wherein $2<n<40$, $0<m<10$, $0<p<5$, $1<q<30$ and $m+n+p+q=1$–45 and $n/q=0.1$–4 and have such values as to meet the above requirements;

$$R_fO(\underset{\underset{CF_3}{|}}{CF}-CF_2O)_n-R'_f$$

wherein $R_f$ or $R_f'$, like or different from each other, are $-C_2F_5$ or $-C_3F_7$ or one of the above carboxylic radicals, wherein $1<n<30$;

5) $R_fO(CF_2CF_2O)_nR'_f$ wherein $R_f$ and $R'_f$, like or different from each other, are $-CF_3$, $-C_2F_5$, or one of the above carboxylic radicals, wherein $1<n<40$;

6) $R_fO(CX_2CF_2CF_2O)_nR'_f$ wherein $R_f$ and $R'_f$, like or different from each other, are $-CF_3$ or $-C_2F_5$ or $-C_3F_7$ or one of the above carboxylic radicals, X is F or H, and wherein $1<n<30$;

7) T-O $$T-O\left(\underset{\underset{CF_3}{|}}{CF_2CFO}\right)_n\left(\underset{\underset{X}{|}}{CFO}\right)_m$$

wherein X is F or $CF_3$, R is F or Cl or Br or I, R', like or different from R, is also F or Cl or Br or I, Y is a —COOH group or a perfluoroalkyl group, T is a perfluoroalkyl group containing one or two atoms of Cl or Br or I; including Alog $CF_2$—, Alog $$\underset{\underset{CF_3}{|}}{CF_2CF}-$$

where Alog is Cl or Br or I, n ranges from 1 to 15, the m/n ratio ranging from 0.01 to 0.5.

Perfluoropolyethers of class 1) are commercially known under the trademark Fomblin ®Y or Galden ®; the ones of class 2) are commercially known under the trademark Fomblin ®Z, all of them being produced by Montedison and being further described in U.S. Pat. Nos. 3,665,041; 4,720,527; and 4,755,330, the entire disclosures of which are herein incorporated by reference.

Products of class 4) are known on the market are the Krytox ®(du Pont) and being further described in Belgian Patent 616,756 and U.S. Pat. No. 3,250,808, the entire disclosures of which are herein incorporated by reference. Products of class 5) are described in U.S. Pat. No. 4,523,039 or in J. Am. Chem. Soc. 107, 1197–1201 (1985), the entire disclosures of which are hereby incorporated by reference.

Products of class 6) are described in European Patent No. 148,482 in the name of Daikin, hereby incorporated by reference.

The products of class 3) (Fomblin K) are prepared according to U.S. Pat. No. 3,665,041, hereby incorporated by reference.

The products of class 7) are described in Italian Patent Application Nos. 20,406 A/88 and 20,407 A/88 in the name of the applicants, and in EP 0340739 and 0340740 all of which are hereby incorporated by reference.

A second, not necessary but still a very useful ingredient, in particular, to increase the stability of the aqueous microemulsion when it contains nonfunctional (neutral) PFPE, is a hydrogenated aliphatic alcohol in particular isopropanol, or a fluorinated alcohol such as a perfluoropolyether with end group —OH and a low molecular weight (less than or equal to 450).

The alcohol amount in the aqueous composition may reach even 20% by weight, usually it does not exceed 10%. Useful data in this regard are contained in the already cited European patent application EP-A-250766.

The lubricating compositions according to the invention may furthermore contain little amounts of conventional additives endowed with anticorrosive, antiwear properties, surfactants, EP additives, depending on the specific use they are intended.

EXAMPLES

The formulations of a few lubricating compositions according to the invention are indicated in the following examples, which are given for merely illustrative purposes.

In example 13 (Rolling and PSCT, alloys and mechanical characteristics thereof are disclosed e.g., in "Registration records of International alloy designation. Chemical Composition limits for wrought aluminum and wrought alloy". Aluminum Association - Dusseldorf, Washington.

EXAMPLE 1

Composition:

23.0 g of a monocarboxylic acid with perfluoropolyethereal structure belonging to class 1, having an average equivalent weight equal to 668;

7.8 ml of an ammonia aqueous solution at 10% by weight of ammonia;

53 ml of isopropyl alcohol;

384 mil of bidistilled water.

The sample contained 4.6% by weight of fluorinated substances and had a viscosity equal to 1.16 cst at 40° C. and an almost neutral pH (product reference: LR.1).

EXAMPLE 2

Composition:

9.4 g of ammonium salt of the monocarboxylic acid with perfluoropolyethereal structure belonging to class 1, having an average equivalent weight equal to 636;

1.3 g of a monofunctional alcohol having perfluoropolyethereal structure belonging to class 1, having an average equivalent weight equal to 600;

0.2 g of triethanolamine sebacate dissolved in 4.2 g of normal-butyl alcohol;

2.7 g of the PFPE having perfluoroalkyl end groups belonging to class 1 and having an average molecular weight equal to 650;

82.2 g of bidistilled water.

The resulting O/W microemulsion contained 13.5% by weight of fluorinated substances and contained 0.2% of triethanolamine sebacate (product reference: 6/87).

EXAMPLE 3

Composition:

17.17 g of a monocarboxylic acid with perfluoropolyethereal structure belonging to class 1, having an average equivalent weight equal to 441;

8.8 ml of an ammonia aqueous solution at 10% by weight of $NH_3$;

284 ml of bidistilled water.

The solution contained 5.0% by weight of fluorinated substances and had a viscosity of 0.75 cst at 40° C.; the pH was equal to 8.2 (product reference: LR.3).

EXAMPLE 4

Composition:

150.4 g of a monocarboxylic acid with perfluoropolyethereal structure belonging to class 1, having an average equivalent weight equal to 443 and a narrow molecular weight distribution;

52.1 g of an ammonia solution at 10% by weight of ammonia;

10.8 g of a perfluoropolyether having an average molecular weight equal to about 1,200;

32.4 g of a fluorinated alcohol having a perfluoropolyethereal structure and a molecular weight equal to 678;

23.0 g of isopropyl alcohol;

293.1 ml of bidistilled water.

The resulting microemulsion contained 6.5% by weight of fluorinated substances and had a pH equal to 4.4 (product reference: LR.17).

EXAMPLE 5

Composition:

18.39 g of a monocarboxylic acid having perfluoropolyethereal structure belonging to class 7, having a chlorofluoroalkyl end group for each molecule and having an average equivalent weight of about 850 and a wide distribution of the molecular weights;

6.44 g of an aqueous ammonia solution at 10% by weight of $NH_3$;

338 g of bidistilled water.

The obtained solution contained 5.1% by weight of chlorofluorinated substances and had a pH equal to 8.3 (product reference LR.15).

EXAMPLE 6

Composition:

19.8 g of a perfluoropolyether belonging to class 1 having carboxylic end groups and an average molecular weight equal to 4170;

14.6 g of isopropyl alcohol;

2.2 g of monocarboxylic acid having perfluoropolyethereal structure, belonging to class 1, having an average equivalent weight of 668;

63.4 g of aqueous phase containing the ammonia which is necessary to salify the carboxylic groups.

The O/W microemulsion obtained by mixing the above components with a fluid, limpid between 25° and 75° C., containing 22% by weight of fluorinated substances and exhibiting a viscosity of 38 cst at 40° C. (product reference: LR.A).

EXAMPLE 7

Composition:

3 g of a functionalized perfluoropolyether belonging to class 1, having carboxylic end groups and an average molecular weight equal to 2080;

19.2 g of isopropyl alcohol;

75.5 g of an aqueous solution containing the ammonia which is necessary to salify the carboxylic groups.

The O/W microemulsion obtained by mixing the above components with a fluid, limpid between 25° and 50° C., containing 5.3% by weight of fluorinated substances and having a viscosity of 2.25 cst at 40° C. (product reference: LR.C).

EXAMPLE 8

25.2 g of a monocarboxylic acid having perfluoropolyethereal structure, belonging to class 1, having an average equivalent weight equal to 668 and a wide distribution of the molecular weights;

9.1 ml of an aqueous ammonia solution at 10% by weight of ammonia;

1.4 ml of a perfluoropolyether having perfluoroalkyl end groups, belonging to class 1 and having an average molecular weight equal to 650;

28 ml of isopropanol;

280 ml of bidistilled water.

The sample was stable in the whole temperature range taken into examination, contained 8.2% by weight of fluorinated substances and had a viscosity of 1.2 cst at 40° C., the pH being equal to 8 (product reference: LR.5).

EXAMPLE 9

Composition:

55.0 g of a monocarboxylic acid having perfluoropolyethereal structure belonging to class 7, having a chlorofluoroalkyl end group per molecule and having an average equivalent weight of about 478 and a wide molecular weight distribution;

62.14 g of triethanolamine;

10.14 g of bidistilled water.

The resulting solution contained 4.8% by weight of chlorofluorinated substances and had a pH equal to 8.36 (product reference: LR.15 TEA).

EXAMPLE 10

Composition:

26.18 g of ammonium salt of the acid belonging to class 1, having an average equivalent weight equal to 441;

1.4 g of a perfluoropolyether of class 1, having perfluoroalkyl end groups and an average molecular weight of about 650;

5.6 ml of isopropyl alcohol;

293 mil of bidistilled water.

The system was limpid in the whole temperature range. It contained 8.8% by weight of fluorinated substances and had a viscosity of 0.85 cst at 40° C. It was brought to a pH=8 by adding thereto 0.15 ml of an ammonia solution at 10% by weight of ammonia (product reference: LR.7).

EXAMPLE 11

Composition:

35.1 g of a monocarboxylic acid of perfluoropolyethereal structure belonging to class 1, having an average equivalent weight equal to 668 and a wide distribution of the molecular weights;

5.4 of a monocarboxylic acid of perfluoropolyethereal structure belonging to class 1, having an average equivalent weight equal to 443 and a narrow distribution of the molecular weights;

11.3 g of ammonia solution at 10%;

2.8 g of a perfluoropolyether of class 1, having perfluoroalkyl end groups and an average molecular weight of about 1,200;
23.6 g of isopropyl alcohol;
300 ml of bidistilled water.

The microemulsion so obtained was stable in the whole temperature range. It contained 11.4% by weight of fluorinated substances and had a pH equal to 7.4. (Product reference: LR.9).

The following examples describe the preparation of additive-containing microemulsions.

EXAMPLE 12

Composition:

108.0 g of a monocarboxylic acid with perfluoropolyethereal structure belonging to class 1, having an average equivalent weight equal to 668;
1.8 g of a monocarboxylic acid with perfluoropolyethereal structure belonging to class 1, having an average equivalent weight equal to 443 and a narrow distribution of the molecular weights;
33.7 g of ammonia solution at 10%;
33.4 g of perfluoropolyether having an average molecular weight of about 1,200;
23.6 g of a solution of triethanolamine sebacate in isopropanol, at 10.2% by weight;
3.1 g of isopropanol;
240 ml of bidistilled water.

The resulting O/W microemulsion contained 32.3% by weight of fluorinated substances and 0.6% by weight of triethanolamine sebacate, and has a pH equal to 7.6 (product reference: LR.10).

EXAMPLE 13

90.3 g of the sample described in the preceding example 12 were diluted with 250 ml of water.

The resulting O/W microemulsion contained 8.6% by weight of fluorinated substances and 0.2% by weight of triethanolamine sebacate, the pH being equal to 5.3 (product reference: LR.11).

The utilization characteristics of the lubricating compositions according to the invention, with reference to specific applications, are illustrated in detail hereinafter.

Rolling

The lubricating compositions under examination were subjected to the "Plane Strain Compression Test" (paper 2015 by R. D. Guminski and J. Willis—Journal of the Institute of Metals, 1959-60, vol. 88). The Plane Strain Compression Test is an improvement of the BISRA Compression Test (see The Rolling of Metals by L. R. Underwood, pages 116-119—Chapman and Hall—London 1952) and is well indicative of the thickness reduction capacity of the lubricants in the cold-rolling of aluminum. The data determined in the plane strain compression test are well in correlation to the behavior in use exhibited by the lubricating mixtures.

Further literature sources on the P.S.C.T., which extend the validity of the test also to steel, are: Kubie and Delamare—Journal of Lubrication Technology, pages 538-551, vol. 104 (1982).

The test carried out according to Guminski/Willis was the following: A 50×2.52×150 mm strip of aluminum alloy 3003-H22 was subjected, after wetting with the lubricant, to 5 successive compressions between two vertical plates measuring 75×6.20 mm in a press mounted in a traction/compression machine, the whole in accordance with the indication given by Guminski and Willis, with the exception that the applied load was of 6,800 kg to make the test more selective.

The fluids of the present invention can be applied to the metal surface according to conventional methods such as immersion, spraying, and by means of jets, brushes, wiping, rollers, or the like.

In the following examples, the application using a brush was utilized.

The results are reported in the following Table.

TABLE 1

| Product | Thickness reduction (%) |
|---|---|
| Oil Lamium ® | 54 |
| Example 1 (LR.1) | 65 |
| Example 2 (6/87) | 67 |
| Example 7 (LR.C) | 60 |
| Example 11 (LR.9) | 62 |

Lamium ® is a rolling oil, which is usually utilized an is based on an isoparaffin mineral oil with 5.6% of lauryl alcohol and minor amounts of fatty acids and of antioxidants (CRODA, U.K., BC21).

Another typical known product is Somentor N. 35 produced by Esso, which gives equivalent results.

Determination of the friction coefficient using the Plane Strain Compression Test (PSCT), as is described by Kubie and Delamare in the above literature. Also this test, which provides the friction coefficient values, permits to evaluate the reduction ratios obtainable in the rolling process.

Metal test-piece (20×300 mm sheet thickness; about 0.6 mm), applied load: 10,000 kg:

a) steel at 0.03% of C and 1% of Mn, annealed;
b) Al/11 g alloy 5052 0, annealed.

The test-pieces were degreased using acetone before being tested. Tested lubricants:

a) composition of example 1 (LR.1);
b) composition of example 5 (LR.15);
c) composition of example 7 (LR.C);
d) composition of example 9 (LR.15 TEA);
e) rolling oil for the steel referred to as Q.27, a commercial product having the following composition:

| | |
|---|---|
| esters of nonylphenols + ethoxylated nonylphenols | 3.95% by weight |
| antioxidant | 0.50% by weight |
| antistain agent | 5.00% by weight |
| animal fats | 40.00% by weight |
| naphthenic mineral oil | 50.00% by weight |
| triethanolamine (TEA) | 0.55% by weight |

f) emulsion of preceding product Q.27 at 10% by weight of water;
g) palm oil;
h) product aqueous emulsion at 4% by weight of the following oil composition:

| | |
|---|---|
| saturated acids $C_{18}$ | 8.0% by weight |
| alcohols $C_8$-$C_{18}$ | 5.0% by weight |
| alcohols $C_{16}$-$C_{18}$ | 2.5% by weight |
| emulsifier | 11.0% by weight |
| polyisobutane dissolved in $C_{17}/C_{18}$ mixture | 73.5% by weight |

The tests on steel were carried out with a load corresponding to a thickness reduction of about 30%; the tests on Al alloy were conducted at a pressure corresponding to a thickness reduction of about 60%.

TABLE 2

(PSCT test on steel)

| OUR REF. | EX. NO. | μ N = 1 | N = 2 | N = 3 | N = 4 | N = 5 | N = 6 | N = 7 | N = 8 | N = 9 | N = 10 |
|---|---|---|---|---|---|---|---|---|---|---|---|
| LRI | 1 | 0.03 | 0.028 | 0.034 | 0.045 | 0.04 | 0.042 | 0.04 | 0.045 | 0.05 | 0.045 |
| LRI 15 | 5 | 0.025 | 0.032 | 0.03 | 0.04 | 0.045 | 0.035 | 0.04 | 0.045 | 0.05 | 0.042 |
| LR.15 TEA | 9 | 0.048 | 0.048 | 0.042 | 0.048 | 0.05 | 0.053 | 0.38 | 0.04 | 0.048 | 0.052 |
| LRC | 7 | 0.042 | 0.03 | 0.032 | 0.03 | 0.04 | 0.038 | 0.04 | 0.045 | 0.045 | 0.045 |
| Q 27 | | 0.052 | 0.052 | 0.052 | 0.065 | 0.062 | 0.060 | 0.060 | 0.065 | 0.065 | 0.07 |
| Q 27 10% | | 0.072 | 0.068 | 0.069 | 0.070 | 0.070 | 0.071 | 0.065 | 0.071 | 0.068 | 0.072 |
| Palm oil (non emuls.) | | 0.057 | 0.057 | 0.060 | 0.058 | 0.060 | 0.060 | 0.060 | 0.065 | 0.065 | 0.060 |

μ = Tresca friction coefficient
N = number of indentations

TABLE 3

(PSCT results on annealed ALUMINIUM 5052)

| OUR REF. | FLUID | NUMBER OF EX. PREP. | μ N = 1 | N = 2 | N = 3 | N = 4 | N = 5 | N = 6 | N = 7 | N = 8 | N = 9 | N = 10 |
|---|---|---|---|---|---|---|---|---|---|---|---|---|
| LR.15 TEA | $ClR_f COONH_4$ solution | 9 | .051 | .05 | .050 | .051 | .052 | .051 | .051 | .052 | .055 | .056 |
| LR.15 | $ClR_f COONH_4$ solution | 5 | .062 | .058 | .058 | .058 | .058 | .057 | .058 | .058 | .058 | .059 |
| LR.1 | Galden solution of salified acid (PE 668) | 1 | .054 | .053 | .049 | .049 | .049 | .05 | .050 | .050 | .052 | .054 |
| T.5263 | hydrocarbon emulsion | Product according to the art | .175 | .148 | .084 | .068 | .070 | .060 | .058 | .057 | .054 | .058 |

μ = Coulomb friction coefficient
N = number of indentations

Dishing

Dishing is the process by which a metal plate is subjected to permanent plastic deformation by buckling between two surfaces (die and punch).

The lubricant must have good EP characteristics (high pressures), i.e. it must secure the sliding between two metal surfaces (sheet iron to be deformed and dies) under a high pressure, and that is achieved by lubricants which do not exhibit any film rupture under such conditions.

The most different lubricants are utilized at present, depending on the type of dishing to be carried out and o the materials to be worked. The lubricants may be a differently additional mineral oil, as well as soap baths, emulsions, waxes, greases, fluoride and phosphate baths, chloroparaffins, polymeric resins, graphite or $MoS_2$ in oil, etc. The PFPE-based aqueous compositions according to the present invention are suited also as lubricants for the dishing process.

The products are novel in this application. They are suited to the dishing of metals because they permit to obtaining a dishing ratio comparable to the ones obtainable with whole oils based on hydrocarbons, while remarkably reducing the necessity to degrease the sheets for the subsequent processings.

The fluids in question may further contain minor amounts of additives, if these should result to be necessary in particular operative conditions.

Such additives may be corrosion inhibitors, antistatic agents, surfactants, slippage agents.

Examples

The fluids of the invention were subjected to the Erichsen test (UNI 8341) on steel FE PO4 (UNI).

The fluids of the present invention are applied to the metal surface using conventional methods such as dipping, spraying, wiping by brushes, roller, or the like. The results, which are reported on the following Table, indicate the depth of penetration, in tenths of mm, of the punch into a sheet-steel having a roughness of 0.8 microns.

TABLE 4

Erichsen values

| | test-piece 1 |
|---|---|
| in dry conditions | 116.3 ± 0.5 |
| standard oil (*) Metalform ® | 126.7 ± 1 |
| LR 5 (example 8) | 124–123.7 ± 0.7 |
| LR A (example 6) | 126.7 ± 0.5 |
| LR C (example 7) | 124–125.7 ± 1.5 |

(*)The oils for dishing usually utilized at present are based on mineral oil and additional fatty acids (antioxidants etc.).

Lubricating properties of the fluid according to the invention.

For the fluids utilized in several plastic processings of metals, good EP characteristics may be required.

To determine the EP characteristics of the microemulsions and aqueous solutions of perfluoropolyethers and derivatives thereof, "Shell 4 balls" tests (IP 239/79) were carried out.

The "Shell 4 balls" tests were always carried out using balls made of steel UNI 100 $CR_6$.

Examples

The fluids according to the invention were subjected to the "Shell 4 balls" test (IP 239/79 ASTM D2783).

The results are indicated in the following Table 5.

TABLE 5

| Ex. | ref. | seizure beginning %(**) | test (Kg) | welding load (Kg) | average load Hertz (Kg) |
|---|---|---|---|---|---|
| 1 | LR1 | 4,6 | 178 | 178 | 55 |
| 3 | LR3 | 5 | 89 | 282 | 78 |
| 5 | LR15 | 5,1 | 200 | 224 | 70 |
| 6 | LRA | 22 | 100 | 178 | 48 |
| 7 | LRC | 5,3 | 251 | 251 | 87 |
| 8 | LR5 | 8,2 | 126 | 178 | 56 |
| 10 | LR7 | 8,8 | 100 | 251 | 71 |
| 11 | LR9 | 11 | 178 | 178 | 56 |
| 14 | LR17 | 6,5 | 251 | 251 | 79 |
| 12 | LR10 | 32,6 | 178 | 178 | 58 |
| 13 | LR11 | 8,6 | 178 | 178 | 62 |
| 19 | LR15TEA | 4,86 | 251 | 316 | 98 |
| (*) | O.C.E. | 6 | 158 | 178 | 60 |
| | O.C.E. | 10 | 178 | 178 | 61 |

(*)Commercial, highly additioned emulsifiable oil composed of: 50% of mineral oil, 3% of chlorinated paraffin, 4% of nonionic emulsifier, 1% of antistain agent, 0.5% of biocide, 40% of animal fat oils, 0.5% of antifoaming agent, 1% of corrosion inhibitors and other agents.

(**)% by weight of product in the aqueous emulsion. The reported data show that the compositions according to the invention possess satisfactory properties in EP conditions also without additives. These properties are comparable with those of commercial products containing a high amount of specific additives.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

We claim:

1. A method for the cold plastic processing of metals, comprising:

introducing a lubricating/refrigerating liquid in a cold processing machine; and processing the metal in said machine in contact with the above said liquid, said liquid being an aqueous composition comprising from 1 to 40% by weight of a perfluoropolyether having an average molecular weight ranging from 400 to 5,000, with end groups of the perfluoropolyethereal chain selected from the group consisting of perfluoroalkyls, carboxylic acids, carboxylic acid salts and mixtures thereof.

2. The method according to claim 1 wherein said end groups are ammonia carboxylates or triethanolamine carboxylates.

3. The method according to claim 1 wherein the aqueous composition is in the form of a microemulsion.

4. The method according to claim 1 wherein the perfluoropolyethers of the aqueous composition have an average molecular weight ranging from 600 to 2,000.

5. The method according to claim 1 wherein the perfluoropolyethers of the aqueous composition are selected from the group consisting of:

1)

$$R_fO(\underset{\substack{|\\CF_3}}{CF}-CF_2O)_n(\underset{\substack{|\\CF_3}}{CFO})_m(CF_2O)_pR'_f$$

with a random distribution of the perfluorooxyalkylene units, wherein $R_f$ and $R'_f$, like or different from each other are, $-CF_3-$, $-C_2F_5$, $-C_3F_7$, or —COOH, $-CF_2COOH$, and m, n, p have such values to meet the above average molecular weight requirements:

2) $R_fO(CF_2CF_2O)_n(CF_2O)_mR'_f$, with a random distribution of the perfluorooxyalkylene units, wherein $R_f$ and $R'_f$, like or different from each other, are $-CF_3$ or $-C_2F_5$, or —COOH, $-CF_2COOH$ and m and n have such values as to meet the above average molecular weight requirements;

3)

$$R_fO(CF_2CF_2O)_n(CF_2O)_m(\underset{\substack{|\\CF_3}}{CFO})_p(\underset{\substack{|\\CF_3}}{CF}-CF_2O)_q-R'_f$$

with a random distribution of the perfluorooxyalkylene units, wherein $R_f$ and $R'_f$, like or different from each other, are $-CF_3$, $-C_2F_5$ or $-C_3F_7$, or —COOH, or $-CF_2COOH$ and m, n, p, q have such values as to meet the above average molecular weight requirements;

4)

$$R_fO(\underset{\substack{|\\CF_3}}{CF}-CF_2O)_n-R'_f$$

wherein $R_f$ or $R'_f$, like or different from each other, are $-C_2F_5$ or $-C_3F_7$ or —COOH, or $-CF_2COOH$ and n has such a value as to meet the above average molecular weight requirements;

5) $R_fO(CF_2CF_2O)_nR'_f$, wherein $R_f$ and $R'_f$, like or different from each other, are $-CF_3$, $-C_2F_5$, or —COOH, or $-CF_2COOH$ and n has such a value as to meet the above average molecular weight requirements; and 6) $R_fO(CX_2CF_2CF_2O)_nR'_f$ wherein $R_f$ and $R'_f$, like or different from each other, are $-CF_3$ or $-C_2F_5$ or $-C_3F_7$ or —COOH, or $-CF_2COOH$, X is F or H, n having such a value as to meet the above average molecular weight requirements.

6. A method for the cold plastic processing of metals, comprising:

introducing a lubricating/refrigerating liquid in a cold processing machine; and processing the metal in said machine in contact with the above said liquid, said liquid being an aqueous composition comprising from 1 to 40% by weight of a perfluoropolyether having an average molecular weight ranging from 400 to 5,000, said perfluoropolyether having the formula, $$T-O\left(\underset{\substack{|\\CF_3}}{CF_2CFO}\right)_n\left(\underset{\substack{|\\X}}{CFO}\right)_m$$

wherein X is F or $CF_3$, R is F or Cl or Br or I, R', like or different from R, is also F or Cl or Br or I, Y is a —COOH group or a perfluoroalkyl group, T is a perhaloalkyl group selected from the group consisting of Alog $CF_2$—, and Alog $$\underset{\substack{|\\CF_3}}{CF_2CF}-$$

where Alog is Cl or Br or I, n ranges from 1 to 15, the m/n ratio ranging from 0.01 to 0.5.

* * * * *